United States Patent [19]

Witherell et al.

[11] Patent Number: 4,480,999

[45] Date of Patent: Nov. 6, 1984

[54] FIREARM RECOIL SIMULATOR

[75] Inventors: James L. Witherell, Oxnard; Michael D. Tibbet, Port Hueneme, both of Calif.

[73] Assignee: Advanced .45 Technology, Oxnard, Calif.

[21] Appl. No.: 549,176

[22] Filed: Nov. 7, 1983

[51] Int. Cl.[3] ..... F41F 27/00

[52] U.S. Cl. ..... 434/18

[58] Field of Search ..... 434/18, 24

[56] References Cited

U.S. PATENT DOCUMENTS

| | | | |
|---|---|---|---|
| 4,050,166 | 9/1977 | Swiatosz et al. | 434/18 |
| 4,194,304 | 3/1980 | Wolcott | 434/18 |
| 4,302,190 | 11/1981 | Shaw et al. | 434/18 |
| 4,365,959 | 12/1982 | Caurant et al. | 434/24 |
| 4,380,437 | 4/1983 | Yarborough, Jr. | 434/18 |

*Primary Examiner*—William H. Grieb

*Attorney, Agent, or Firm*—Kenneth J. Hovet

[57] ABSTRACT

An assembly of parts for attachment to a firearm that provides a kickback reaction when the trigger is pulled without the use of live ammunition. A power source operates a drive means attached to the firearm to push back a slide which cocks the firearm hammer. A control means is interposed between the drive means and power source to regulate operation in response to the hammer position.

19 Claims, 5 Drawing Figures

FIREARM RECOIL SIMULATOR

BACKGROUND OF THE INVENTION

1. Field of the Invention

The present invention relates to firearms and, more particularly, to providing a means for simulating firearm recoil.

2. Description of the Prior Art

Because of the lethal characteristics inherent in operating guns, proper training in their use is imperative. Such training most often involves the firing of blanks or live ammunition. Loud noise, spent cartridge waste, noxious burned powder odors, repetitive reloading, environmental constraints, high cost and overall danger are all substantial detriments to the use of blanks or live ammunition.

To overcome the above disadvantages, training devices have evolved for simulating the firing of guns. These devices relate to weaponry having primarily military use. U.S. Pat. No. 4,302,190 discloses a rifle recoil simulator whereby compressed air passes through orifices in the rifle barrel to force the barrel upward in a recoil motion. A trigger switch activates an electronic timer-solenoid-air valve system for controlling air passage to the barrel orifices.

Artillery loading and recoil simulators are described in U.S. Pat. Nos. 4,194,304 and 4,365,959. These are complex mechanisms designed to train entire gunnery crews. They are not directly related to firearm recoil, which is the subject of the present invention.

SUMMARY OF THE INVENTION

The present invention provides a simple means for simulating the kickback action of a firearm without the many serious disadvantages inherent with firing live ammunition or blanks. Civilian, police and military personnel may save the costs of ammunition and have a safe effective means for obtaining instruction in using a firearm.

Instead of exploding gunpowder, the invention uses innocuous compressed gas or fluid, mechanical, electrical and/or magnetic means to drive a firearm mechanism that cocks a hammer—such as a slide in an auto-loading gun. Forceful movement of the slide creates a kickback or recoil motion. The hammer position is sensed by an actuating means which operates in a predetermined manner to activate the drive means for repetitive simulated firing and recocking of the hammer.

DESCRIPTION OF A PREFERRED EMBODIMENT

Figure 1:
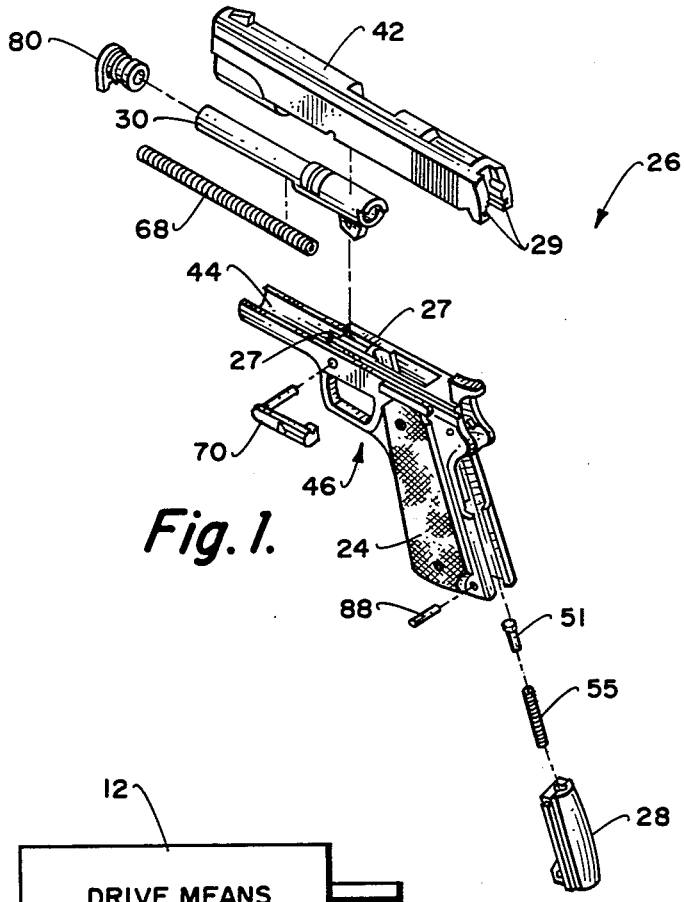
FIG. 1 is an exploded perspective view of a prior art handgun with which the recoil simulator system of the invention may be used.
Figure 2:
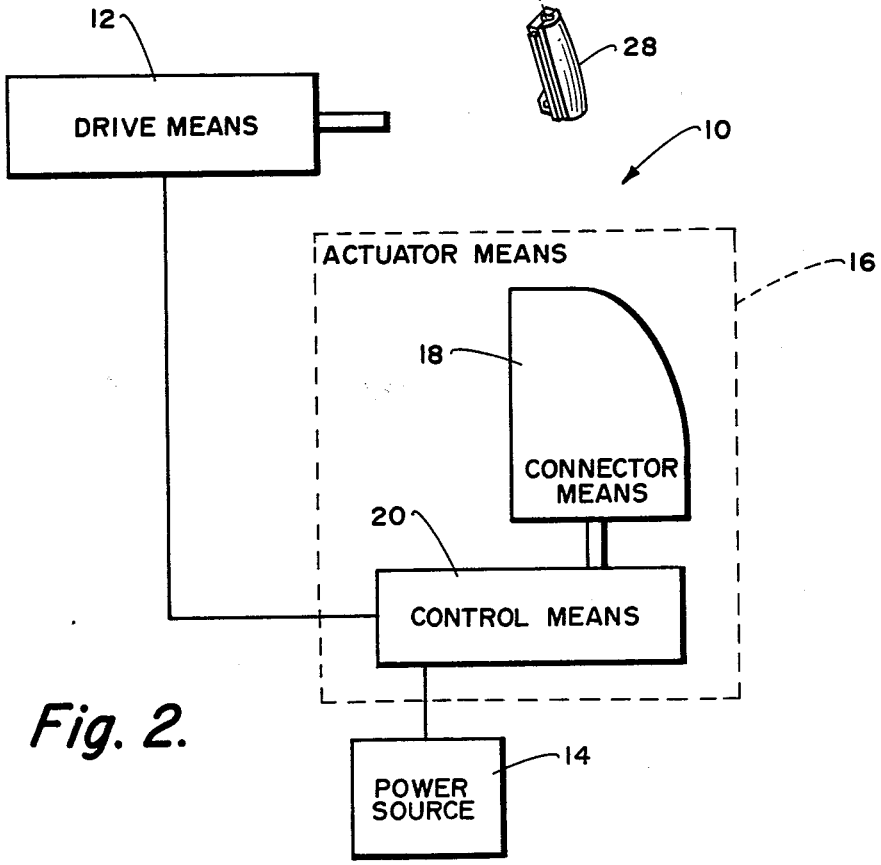
FIG. 2 is a schematic showing the recoil simulator system of the present invention.

Referring now to the drawings and, more particularly, to FIG. 2, the overall recoil simulator system of the invention is shown generally by reference numeral (10). The system includes a drive means (12) connected to a power source (14) through an actuator means (16). The actuator means comprises a connector means (18) linking a firearm hammer to a control means (20). With reference to FIG. 1, prior art handgun (26) is illustrated having a frame (44). The aforesaid connector means may preferrably be housed in at least a lower portion (24) of said frame. In handgun (26) said frame portion includes a removable main spring housing (28). The housing can be readily adapted to include the connector means and possibly other parts of the recoil simulator assembly of the present invention in a manner to be hereinafter described.

In general, the connector means transmits the position of hammer (22) to the control means which, in turn, operates to control power to the drive means in response to the hammer position. The connector means may be any one or combination of mechanical, electrical, magnetic, optical, fluidic or gaseous means for linking hammer position to the control means. The control means should be correspondingly operative with any one or combination of the above linkages, and with a power source functional to operate any of the above.

Figure 4:
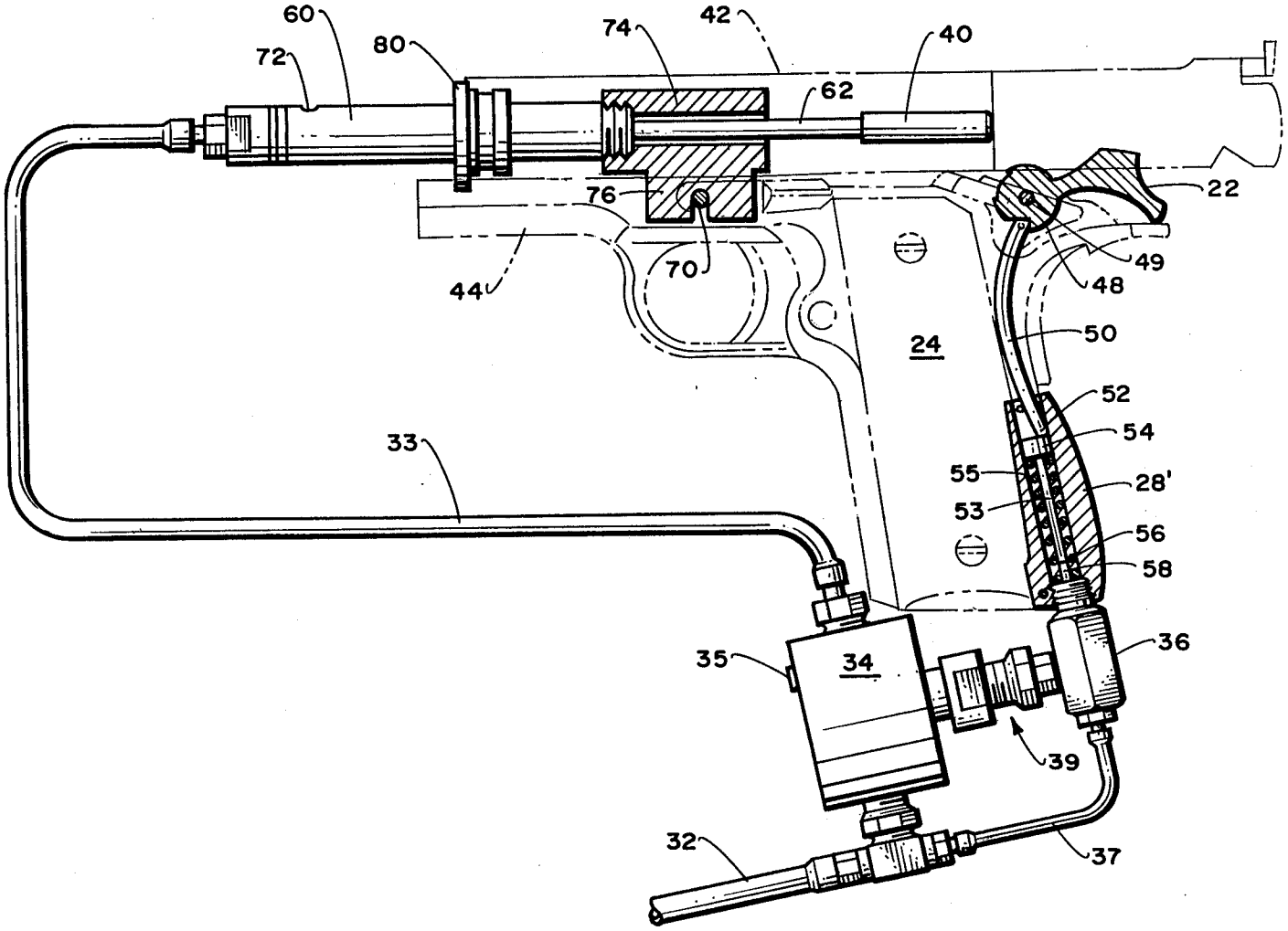
FIG. 4 is the handgun and recoil simulator of FIG. 3, except that the hammer is shown in a cocked second position with cooperating parts moved in correspondence thereto.

With the specific embodiment shown in the drawings, the power source is an external compressed gas source from a pressure tank or compressor (not shown) connected by conduit (32) to control means (20). The control means comprises an interface valve (34) which is activated by signal valve (36). The interface valve controls the flow of compressed gas to the drive means shown as piston mechanism (38). The piston mechanism includes pressure cylinder (60) within which reciprocates piston (62). The external end of the piston is equipped with a drive member (40) pushing against firearm slide (42) causing it to rotate hammer (22) into a cocked (second) position as shown in FIG. 4. With the hammer in a cocked position, the control means will shut-off the power, i.e., compressed gas, to the piston mechanism. When the hammer is in a down (first) position, the control means will allow compressed gas to charge the piston mechanism and cause the drive member to be forced against the slide. In this manner, the hammer may be successively and repetitively cocked and released as desired by a user.

Figures 3, 5:
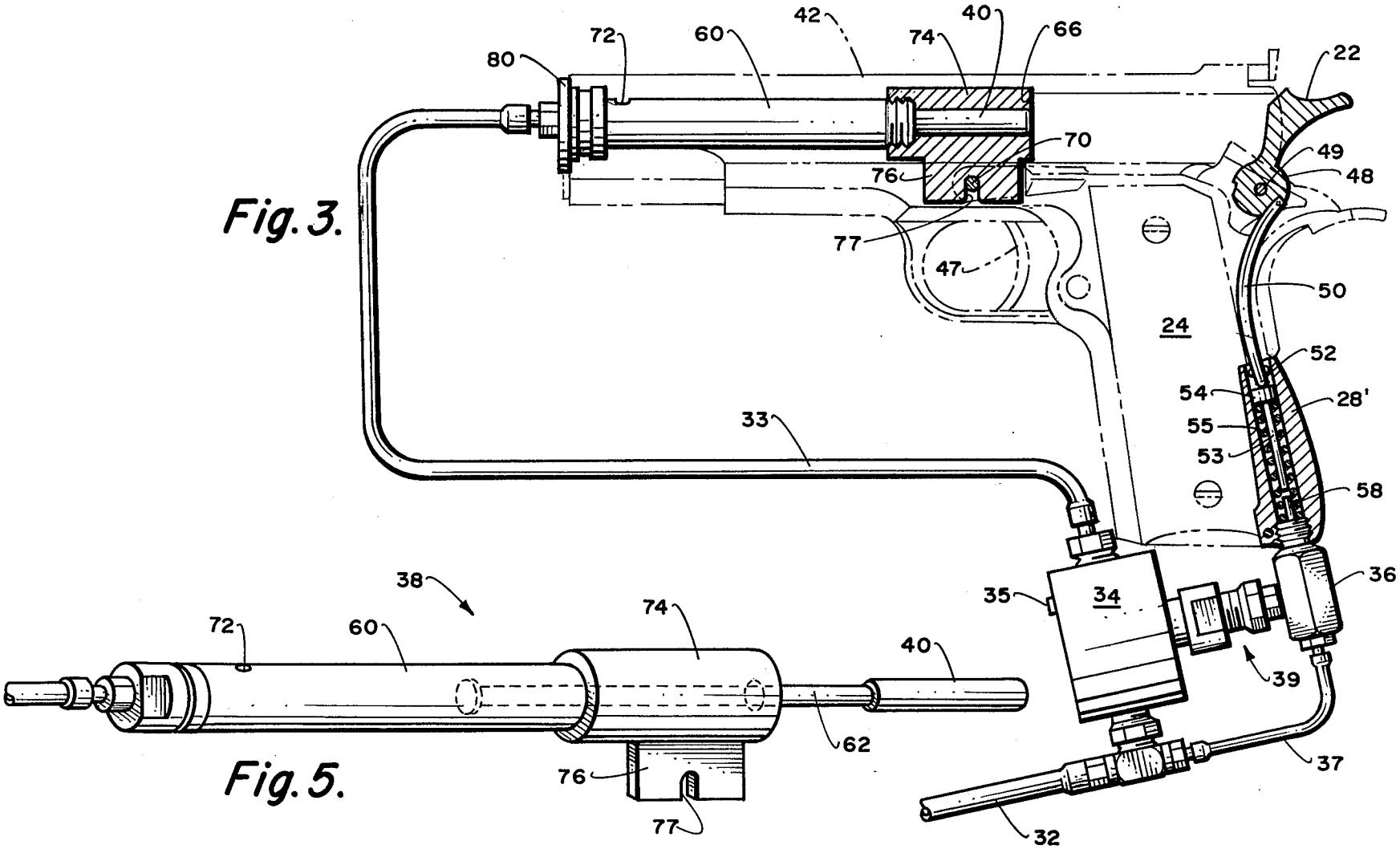
FIG. 3 is a side elevation view of an illustrative embodiment of the recoil simulator system of FIG. 2 attached to the auto-loading handgun of FIG. 1, shown in phantom, with the hammer in a fired or down first position.
FIG. 5 is an enlarged perspective view of a pressure cylinder and piston, shown in phantom, used in the simulator shown in FIGS. 3 and 4.

Reference now will be made to FIGS. 1, 3 and 4 showing details of handgun (26) and how the recoil simulator system of the present invention attaches to and operates in conjunction with said handgun. It will be understood, however, that the invention may be adapted for use with other types of firearms operated by a trigger and hammer mechanism. The handgun shown is of the auto-loading type Model 1911 Colt .45 having a frame (44) and trigger mechanism shown generally by (46). The frame includes a reciprocating slide (42) that is guided longitudinally along frame flanges (27) and slide grooves (29) over stationary barrel (30). Hammer (22) is pivoted to the frame about shaft (48) which extends through the lower cylindrical portion (49) thereof.

Strut (50) is pivoted to the periphery of cylindrical portion (49) so that its axis of rotation is parallel and offset from the hammer rotational axis. In this manner, the strut reciprocates longitudinally as the hammer rotates between positions.

The free end (52) of the strut normally contacts cap pin (51). Hammer spring (55) pushes the cap pin against the strut end to always exert a rotational force on the hammer so that the hammer is always disposed to an uncocked first position as shown in FIG. 3. Of course, trigger (47) via trigger mechanism (46) is always spring-biased to an unpulled position and is connected to the hammer by mechanical linkage known in the art. Such linkage may be observed by reference to the aforementioned Colt Model 1911.

It will be appreciated that only those parts deemed necessary for an understanding of the recoil simulator system of the present invention are described herein. As will be apparent, such system is adapted to the aforementioned handgun without permanent alterations whereby the entire system can be removed and the handgun restored to its original condition for use with live ammunition.

As mentioned hereinabove, frame portion (24) includes a removable hammer spring housing (28). This housing slides downwardly from the bottom end of the frame so that it can be adapted to provide the connection for transmitting the hammer position to the control means. Such adaptation is accomplished by substituting plunger (53) for cap pin (51). The plunger is elongated and has a head (54) and an opposing end (56). As with cap pin (51), the head contacts free end (52) of the strut (50) and spring (55), always in compression, biases the strut upwardly to impart a rotational force to the hammer.

The bottom of the main spring housing is threaded so that signal valve (36) may be secured thereto. The signal valve has an internal movable valve member (not shown) with an external stem (58). As shown in FIG. 4, when the hammer is cocked, the plunger opposing end (56) contacts stem (58) and depresses it thereby allowing compressed gas from the power source to close the interface valve and prevent pressurized gas from flowing through conduit (33) into piston mechanism (38).

The interface valve is normally open and is closed when receiving signal gas through connector (39) from the signal valve. It includes an exhaust port (35) that opens when the valve is closed and allows pressurized gas from conduit (33) to be exhausted upon the return stroke of piston (62). Clippard Minimatic Pow-R-Amp Valve Model No. 2012 is an example of an interface valve suitable for use for the present invention. Clippard Minimatic Mavo-3 Miniature Control Valve is an example of a signal valve that can be utilized with the present invention.

As described above, the normally open signal valve will maintain the normally open interface valve closed with power source compressed gas. Upon depressing stem (58), the signal valve will become closed to compressed gas from tube (37) and the interface valve will thereby open and allow flow of such gas from conduit (32) to conduit (33) and the piston mechanism (38). The gas will move the piston drive member against abutment surface (66) of slide (42) with sufficient force to overcome the strength of slide spring (68). The slide will thereby move backwards over the hammer and cause it to become cocked. When the hammer is cocked, the overall sequence is reversed. Gas pressure is released with the slide and piston returning to their original position by force of compressed slide spring (68).

Note that preferrably, the pressure cylinder is double-acting and thereby avoids an internal spring which might operate against compression spring (68). Such cylinder includes a check valve exhaust port (72) to allow gas to be expelled during the return stroke of the piston. Note also that pressure cylinder (60) is sized to replace the handgun barrel and includes an adapter (74) having a flange (76) with notch (77) for stationary engagement to frame (44) with removable slide stop (70).

In practice, it is expected that the original hammer spring housing (28) will be replaced with a substitute containing the aforementioned plunger and hammer spring arrangement with the signal and interface valves being an integral part thereof. In some cases, however, it may be preferrable to locate at least the interface valve at the power source. Also, the piston mechanism will be a replacement for the handgun barrel. Upon effecting such substitutions, it is a simple matter to connect the appropriate conduits to the compressed gas so that operation of simulated firing and recoil may commence.

ASSEMBLY AND OPERATION

For illustrative purposes, it will be assumed that the user will begin with the auto-loading handgun shown in FIG. 1 as purchased from the factory. Such handgun will be described as being fitted and subsequently operated with the recoil simulator system of the present invention as shown schematically in FIG. 2. It is expected that commercially, the aforesaid system will be marketed in a kit form including all necessary adaptive parts for attachment to a wide variety of rifles, pistols, and other types of firearms that utilize a cocking hammer to fire ammunition.

To disassemble the existing gun preparatory to fitting it with the recoil system, barrel bushing (80) is first rotated to disengage it from the end of slide (42). Upon its removal, recoil spring (68) will come out of the lower portion of the slide. Slide stop (70) may then be removed manually by grasping and pulling it transversely from corresponding openings in the frame. This allows the slide (42) and barrel (82) to be slid away from the frame. The barrel may then be simply lifted out of the slide and piston mechanism (38) inserted in its place. The slide and piston mechanism are then placed onto the frame and the slide stop is reinserted through the corresponding receiver holes, taking care to insure that notch (77) of flange (76) is in alignment therewith. Recoil spring is then replaced into the lower slide housing and the barrel bushing is again engaged with the open end of the slide. It will be noted that in some cases, depending upon the power source and mechanisms being utilized, it may be desirable to exchange the original recoil spring with one having less compressive strength.

The main spring housing (28) is now removed by manually pressing out pin (88). This allows the housing to slide down and out of the end of frame (24). Here, it is expected that an entirely new housing (28') will be provided enclosing the original hammer spring (55) and elongated plunger (53), which is substituted for cap pin (51). The replacement housing will have threadedly attached to it signal valve (36) to which is connected interface valve (34) as shown in FIGS. 3 and 4.

The replacement housing (28') may next be slid into place, taking care that the free end (52) of strut (50) will be in contact with plunger head (54). It will be appreciated that the length of the plunger will be such that it will not operate to depress stem (58) unless hammer (22) is in its second cocked position. This, then, will properly allow strut (50) to depress the plunger which in turn depresses the aforesaid stem the required amount to close the signal valve and shut-off signal gas to interface valve (34).

After the replacement housing is in place, pin (88) may be reinserted and conduit (33) may be connected to the outlet of the interface valve and piston mechanism, respectively. As shown in FIGS. 3 and 4, this may be done most simply by friction engagement of a plastic tube upon a metal tube and bushing arrangement well known in the art. In the same manner, power source (14) such as compressed gas from a pressurized tank, cylinder, compressor or the like, is connected by conduit (32) to the inlet of interface valve (34) and interconnecting conduit (37) is used to supply the signal valve with power source gas.

The recoil simulator system of the present invention is now attached to the aforesaid handgun and a simulated shooting sequence will now be described. Initially, it is preferrable to manually pull the hammer back into its cocked second position. This avoids an initial recoil action when the compressed gas enters the system. With the hammer cocked, the gas is slowly turned on and the system checked for leaks. With the specific illustrative embodiment herein described, generally 80–120 psig is adequate to operate the piston mechanism and drive the slide in the same manner as an exploding cartridge. The specific pressure utilized will be dictated by the characteristics of each firearm being utilized and the desires of the user.

With the hammer in a cocked position, the strut will be in its lowermost position causing the plunger (53) to depress stem (58) thereby moving the normally open signal valve to close off signal gas to the normally open interface valve. Actuating the trigger mechanism (46) by pulling trigger (47) allows the hammer to rotate about shaft (48) and draw strut (50) upwardly. Main spring (55) thereby pushes against plunger head (54) and pulls the opposing end (56) away from stem (58). This allows the signal valve to return to its open position and allow source air through conduits (32) and (37) to pass therethrough into the interface valve and close it to further pressurized gas from the power source.

While the interface valve was open, power source gas flowed through the valve and conduit (32), entered pressure cylinder (60) and forced piston (62) outwardly along its longitudinal axis against slide abutment (66). The length of travel of the piston is predetermined to push the slide with a distance sufficient to move the hammer into a cocked position. Thereafter, compression spring (68), pushing between flange (76) and barrel bushing (80), forces the slide to return to its original position as shown in FIG. 3. During the return stroke, air in the pressure cylinder is exhausted through a check valve port (72) while the gas in conduit (33) is exhausted through outlet (35) of the interface valve. The above sequence can be repeated as often as one pulls trigger (47)—with recoil or kickback being created by the forceful action of the slide and its inertia as it rapidly moves rearward over the hammer.

While the above has been described with respect to compressed gas, it will be apparent that the power source could be electrical in the form of alternating (household current) or direct current (batteries or portable battery pack) wherein the piston mechanism may be a solenoid device controlled by known electronic circuitry in place of the abovedescribed valves and conduits. In such case, it may also be desirable to simply detect hammer position by electrical, optical or magnetic contact means rather than the mechanical linkage shown in the illustrative embodiment. Also, it is within the purview of the present invention to utilize the drive means directly against the hammer without an intervening slide. This most likely would be the case with rifle or non-autoloading mechanism.

Still further, and as is already well known, a firearm adapted with the present invention may be equipped with a laser system for further enhancing marksmanship with a target sensitive to laser light. This, of course, will allow a user to beome efficient in sighting the firearm, obtaining the appropriate trigger sensitivity and muscle control, and will help develop the necessary concentration for good marksmanship while still experiencing recoil. Also, use of the invention allows military and police personnel to train in situations which may be encountered in the actual field without risk from use of live ammunition. Such practice can occur with projectors and screens in classrooms without the need for outdoor firing ranges.

While the invention has been described with respect to preferred embodiments, it will be apparent to those skilled in the art that other modifications and improvements may be made without departing from the scope and spirit of the invention. Accordingly, it is to be understood that the invention is not to be limited by the aforesaid illustrative embodiments, but only by the scope of the appended claims.

We claim:

1. A firearm having a recoil simulator comprising:
   a firearm assembly including a frame having a trigger mechanism that includes a trigger extending from said frame linked to a hammer pivotally mounted on said frame;
   actuating means connected to said frame and activated by the trigger mechanism; and,
   drive means mounted on said frame and operatively connected to said actuating means whereby activation of said trigger mechanism will actuate the drive means and cause it to create a recoil motion to the firearm, said drive means including a drive member that causes the hammer to move from a first position to a second position.

2. The firearm of claim 1 wherein said actuating means comprises a connector means mounted on said frame to transmit the position of said hammer to a control means, said control means connecting a power source to the drive means and includes means to control power to said drive means in response to the position of said hammer.

3. The firearm of claim 2 wherein said connector means is a linkage selected from the group consisting of mechanical, electrical, magnetic, optical, fluidic, gaseous, or any combination thereof and wherein the control means is correspondingly operative with any of said group and with a power source selected from any of said group.

4. The firearm of claim 3 including a slide mounted to reciprocate on said frame between a first position corresponding to hammer down and a second position corresponding to hammer cocked, said slide biased toward the first position and moved by said drive means to the second position against said hammer to cause it to become cocked.

5. The firearm of claim 4 wherein the connector means comprises a plunger and a strut pivotally connected to the hammer having a free end in contact with the head of the plunger, said plunger having an opposing end adapted to actuate the control means.

6. The firearm of claim 4 wherein said plunger is located within a portion of said frame; said strut connection being offset from the hammer pivot axis with said plunger having biasing means to urge said head against the strut and thereby leverage said hammer to the hammer down position.

7. The firearm of claim 4 wherein the power source is compressed gas or fluid and the control means comprises an interface valve that allows said gas or fluid to operate said drive means when the hammer moves to the down position.

8. The firearm of claim 7 wherein said control means includes a signal valve linking said plunger to the interface valve, said signal valve being actuated by said plunger to activate the interface valve.

9. The firearm of claim 8 wherein the power source gas or fluid is in communication with the signal valve, said valve having a normally open internal valve member that allows a signal portion of power source fluid or gas to communicate with the interface valve, said valve member including a stem having an end proximate the opposing end of said plunger for contact therewith when the hammer is cocked.

10. The firearm of claim 9 wherein said interface valve is normally open to the power source fluid or gas and becomes closed when receiving signal gas or fluid from the signal valve, said interface valve including an exhaust port that opens when the interface valve is closed.

11. The firearm of claim 7 wherein said piston mechanism is mounted on said frame in place of the firearm barrel and includes a cylinder enclosing a reciprocating piston the free end of which includes said drive member.

12. A recoil simulator kit adapted for use with an autoloading firearm having cooperating frame, trigger, hammer and barrel means comprising:

a power source;

recoil drive means interchangable with the firearm barrel, said drive means operable by power from the power source and including a drive member acting to cock said hammer; and, actuating means adapted for attachment to the firearm comprising connector means to link the position of said hammer with a control means, said control means being interposed between said power source and said recoil drive means for regulating the supply of power from said source to said recoil drive means.

13. The simulator of claim 12 wherein the connector means comprises a linkage selected from the group consisting of mechanical, electrical, magnetic, fluidic, gaseous or any combination thereof and wherein the control means is correspondingly operative with any of said group and said power source is selected from any of said group.

14. The simulator of claim 13 wherein at least a part of said connector means is located within a housing which is interchangable with a removable portion of the firearm frame.

15. The simulator of claim 14 wherein at least a part of said control means is attached to said housing.

16. The simulator of claim 13 wherein said power source is compressed gas, said recoil drive means includes a pneumatic cylinder and the control means includes a gas flow control valve.

17. The simulator of claim 16 wherein said control means includes a signal valve to actuate the control valve upon receipt of a predetermined action from the connector means.

18. The simulator of claim 14 wherein said housing includes an opening therethrough and said part of the connector means includes a plunger that is reciprocal in said opening having a head portion and opposing end, a compression spring in said opening biasing said plunger head against a strut extending from a pivot connection on said hammer into the upper end of said opening, said part of the control means being engageable with the plunger opposing end at the lower end of said opening.

19. The simulator of claim 18 wherein said part of the control means includes a signal valve having an external actuating stem that is engageable with the opposing end of said plunger. -

* * * * *